United States Patent [19]

Kiba et al.

[11] Patent Number: 4,924,892

[45] Date of Patent: May 15, 1990

[54] PAINTING TRUCK WASHING SYSTEM

[75] Inventors: Hiroshi Kiba; Kenzou Nagano; Shigeru Sumiyoshi, all of Hiroshima, Japan

[73] Assignee: Mazda Motor Corporation, Hiroshima, Japan

[21] Appl. No.: 225,371

[22] Filed: Jul. 28, 1988

[30] Foreign Application Priority Data

Jul. 28, 1987 [JP] Japan ..... 62-115284
Aug. 27, 1987 [JP] Japan ..... 62-211373

[51] Int. Cl.[5] ..... B08B 3/02

[52] U.S. Cl. ..... 134/123; 134/198; 134/157; 134/147; 134/156; 118/70; 118/305; 118/319

[58] Field of Search ..... 134/59, 80, 82, 104, 134/66, 140, 153, 149, 157, 198, 128; 118/70, 305, 319

[56] References Cited

U.S. PATENT DOCUMENTS

| | | | |
|---|---|---|---|
| 1,628,317 | 5/1927 | Hoevel | 134/123 Y |
| 2,626,622 | 1/1953 | Duffy | 134/80 |
| 3,011,501 | 12/1961 | Beranek | 134/123 X |
| 3,306,426 | 2/1967 | Arnold | 118/319 X |
| 3,307,720 | 3/1967 | Davis et al. | 134/66 X |
| 3,989,001 | 11/1976 | Brigham et al. | 118/70 |
| 4,226,325 | 10/1980 | Vandas | 118/70 |
| 4,745,422 | 5/1988 | Matsuoka et al. | 134/153 |
| 4,777,972 | 10/1978 | Adam | 134/172 |

*Primary Examiner*—Frankie L. Stinson
*Attorney, Agent, or Firm*—Staas & Halsey

[57] ABSTRACT

A painting truck washing system includes a painting truck, a washing robot with a spray nozzle, and a turntable unit disposed in a washing booth. The painting truck supported an automobile body during painting of the automobile body. The washing robot cooperates with a selector for selectively spraying compressed water or air to the printing truck from which the automobile body is released. The turntable unit turns the painting truck through 180° after one side surface of the painting truck which opposes the washing robot is washed, thereby washing the other side surface of the painting truck.

16 Claims, 11 Drawing Sheets

PAINTING TRUCK WASHING SYSTEM

BACKGROUND OF THE INVENTION

1. Field of the Invention

The present invention relates to a washing system for washing a painting truck which carried an object to be painted during painting of the object and, more particularly, to a washing system having a washing apparatus for washing a painting truck conveyed along a truck convey line in accordance with a predetermined route.

2. Description of the Related Art

For example, in an automobile manufacturing line, in order to paint a manufactured automobile body, the body is painted while being placed on a truck (painting truck). More specifically, the painting truck is conveyed along a truck convey line in accordance with a predetermined circulation route. A liquid paint or the like is sprayed by a jet-forming means such as a spray to an automobile body placed on the truck in a painting booth. During painting for applying a paint by a spray to the automobile body placed on the painting truck, the paint is undesirably applied to the painting truck itself.

The paint applied to the painting truck is dried and solidified when the paint applied to the surface of the automobile body is dried. For the next painting cycle, a new automobile body is placed on the painting truck with such a solidified paint. When an automobile body is placed on such a truck or the truck is conveyed along the convey line, the painting truck is vibrated. The vibrations cause formation of a powder of microparticles of the paint attached to and solidified on the painting truck. The powder particles may be separated from the surface of the painting truck and float in the air.

When the paint floats in the form of a powder having microparticles, the paint powder may be mixed as a foreign material in a jet of a liquid paint when the liquid paint is sprayed on an unpainted automobile body placed on the painting truck. As a result, the paint powder is undesirably attached to the surface of the automobile body, and an excellent painted surface (very smooth painted surface) cannot be obtained.

In order to solve the above problem, as described in, e.g., Japanese Patent Laid-Open (Kokai) No. 62-31964, there is proposed a washing apparatus wherein a washing chamber is defined in a route of the truck convey line, and washing water with a high pressure is sprayed to the painting truck conveyed in the washing chamber to remove the paint attached to the surface of the painting truck.

Since a washing solution is sprayed to the upper, lower and side surfaces of the painting truck conveyed in the washing chamber in such a washing apparatus, it includes upper nozzles, lower nozzles, and side nozzles. The upper, lower, and side nozzles are driven by separate drive units. That is, since the upper, front, rear, right, and left surfaces of the painting truck are independently washed, thereby space and cost of washing equipment are undesirably increased.

For example, a robot having a nozzle for spraying washing water may be located at a predetermined position facing the truck convey line. In this case, washing water is sprayed to remove the paint attached to the upper, front, right, and left surfaces of the painting truck while the robot is being actuated. When this method is employed, washing water can be optimally sprayed to one (i.e., front surface) of the surfaces of the painting truck which opposes the robot. However, the surface which does not oppose the robot (i.e., rear surface) may not be properly sprayed with washing water.

In order to solve the above problem, robots each with a spray nozzle may be located at two positions interposing the truck convey line therebetween to remove the paint attached to the upper, front, rear, right, and left surfaces of the painting truck. However, since the two robots each with a nozzle for spraying washing water must be arranged as described above, an increase in cost of washing equipment is left unsolved.

SUMMARY OF THE INVENTION

The present invention has been made in consideration of the above situation, and has as its object to provide a washing system for a painting truck wherein paint attached to the painting truck can be effectively and properly removed at a low installation cost.

To attain the above-mentioned object, there is provided a painting truck washing system, comprising: a painting truck which supported an object to be painted during painting of the object; fluid spraying means, disposed on one side of the painting truck, for spraying a high-pressure fluid to the painting truck from which the object is released, thereby washing the painting truck; and posture changing means for changing a posture of the painting truck subjected to washing with respect to the fluid spraying means.

In the washing system for the painting truck which has the arrangement as described above according to the present invention, the fluid spraying means sprays a high-pressure fluid to the painting truck after the painting truck has reached a position opposite to the fluid spraying means. Therefore, the paint attached to one surface of the painting truck which opposes the fluid spraying means can be perfectly washed off.

Thereafter, the posture changing means is actuated to change a posture of the painting truck with respect to the fluid spraying means, so that another surface of the painting truck opposes the fluid spraying means. In this state, the paint attached to this surface of the painting truck can be removed by the fluid spraying means upon spraying of the high-pressure fluid thereto.

With the above operation, only one washing fluid spraying means need be used to decrease the cost of washing equipment, and at the same time all the surfaces of the painting truck can be effectively and properly washed.

It is another object of the present invention to provide a washing system capable of preventing damage to a carrier for conveying the painting truck.

To attain the above-mentioned another object, there is provided a painting truck washing system which further comprises: truck conveying means for conveying the painting truck along a predetermined convey direction; and connecting/separating means for connecting the painting truck to the truck conveying means when the painting truck is conveyed by the truck conveying means and for separating the painting truck from the truck conveying means when the painting truck conveyed to the predetermined position by the truck conveying means is moved to the posture changing means.

It is still another object of the present invention to provide a washing system capable of automatically separating the carrier from the painting truck and improving working efficiency.

To attain the above-mentioned still another object, there is provided a painting truck washing system, wherein the connecting/separating means includes: a vertically movable connecting pin; and displacing means for displacing the connecting pin between a position where the painting truck is connected to the carrier and a position where the painting truck is separated from the carrier, thereby automatically connecting-/separating the painting truck to/from the carrier.

It is a further object of the present invention to provide a washing system capable of preventing deviation of a painting truck position from a preset position during a change in posture of the painting truck and capable of properly washing the painting truck.

To attain the above-mentioned further object, there is provided a painting truck washing system, wherein the posture changing means includes a turntable on which the painting truck is placed, the turntable being provided with a vertical rotating shaft, and the fluid spraying means is disposed on one side of the posture changing means, and which further comprises reverse-running preventing means, disposed on the turntable on a loading side of the painting truck, for preventing movement of the painting truck loaded on the turntable in a direction opposite to a loading direction.

It is still a further object of the present invention to provide a washing system capable of shortening a washing time and improving washing efficiency.

To attain the above-mentioned still further object, there is provided a painting truck washing system, wherein the fluid spraying means includes: a first tube for supplying a high-pressure liquid; a second tube for supplying a high-pressure gas; a nozzle, a distal end of which is located to oppose the posture changing means, the high-pressure liquid and the high-pressure gas being selectively sprayed from the distal end of the nozzle; and selecting means, interposed between the nozzle and the first and second tubes, for selectively supplying the high-pressure liquid and gas respectively supplied through the first and second tubes to the nozzle.

Other features and advantages of the present invention will be apparent from the following description taken in conjunction with the accompanying drawings, in which like reference characters designate the same or similar parts throughout the figures thereof.

DETAILED DESCRIPTION OF THE PREFERRED EMBODIMENTS

A washing system for a painting truck according to a first embodiment of the present invention will be described with reference to FIGS. 1 to 10.

Figure 1:
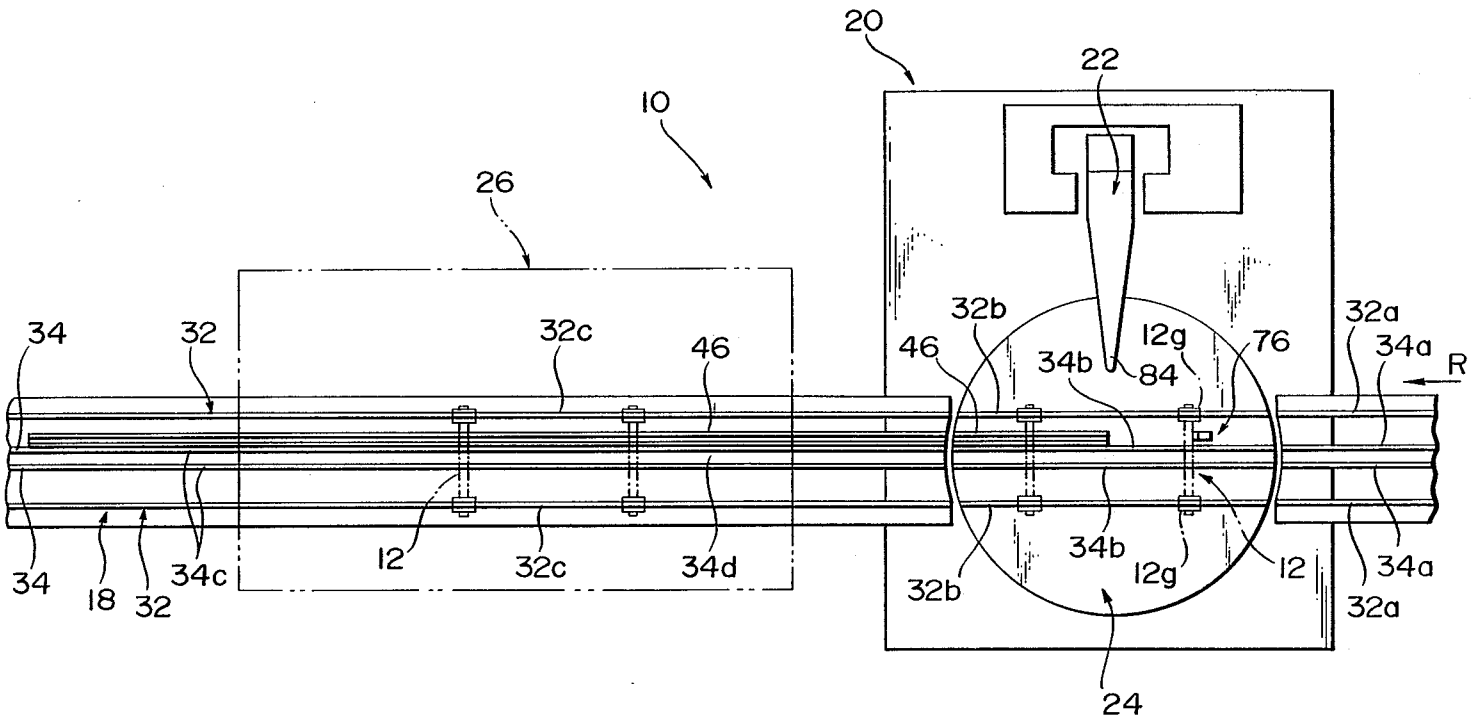
FIG. 1 is a schematic plan view showing a washing system according to a first embodiment of the present invention.

FIG. 1 schematically shows the overall structure of a washing system 10 for a painting truck according to the first embodiment.

Figure 2:
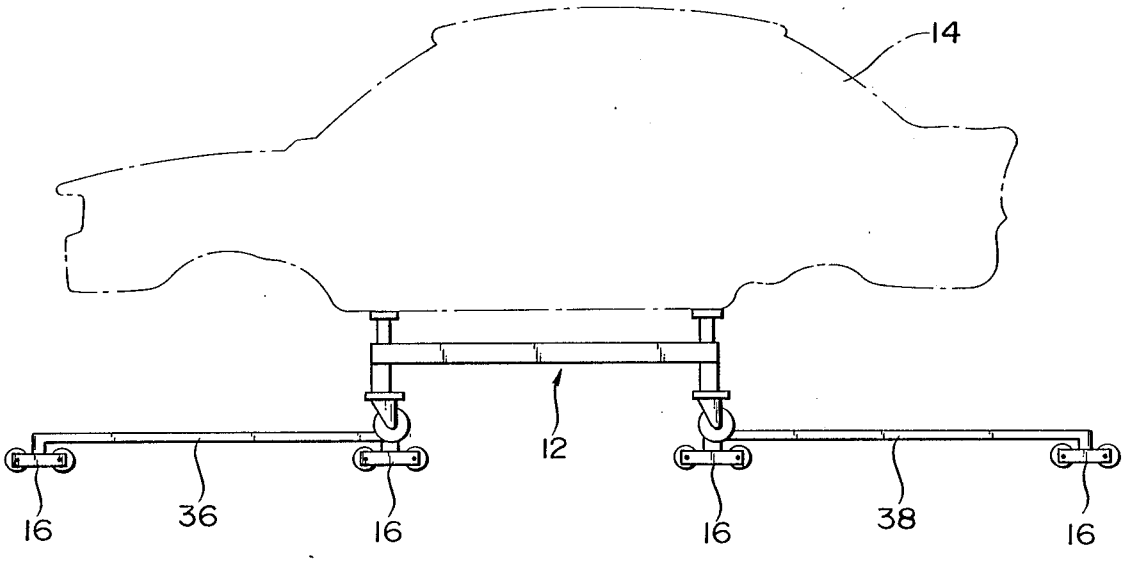
FIG. 2 is a front view showing a painting truck to be washed and a carrier for allowing conveyance of the painting truck.

The washing system 10 shown in FIG. 1 washes a painting truck 12 shown in FIG. 2 to remove a painting coating attached to and solidified on the painting truck 12 in the previous painting process. More specifically, in an automobile manufacturing line of an automobile manufacturing technique, when an automobile body 14 (indicated by the alternate long and short dashed line in FIG. 2) is to be painted, the body 14 is placed on the painting truck 12 and conveyed along a painting line (not shown) during travel of the painting truck 12, thereby performing painting. The automobile body 14 painted and dried in the painting line is released from the painting truck 12 and is fed out to the next process.

The painting truck 12 painted together with the automobile body 14 in the painting booth is conveyed to the washing system 10. The painting truck 12 is connected to a carrier 16 (to be described later) and is conveyed along a washing line 18 of the washing system 10.

The structure of the washing system 10 will be described in detail.

As shown in FIG. 1, the washing system 10 comprises: the washing line 18; a washing booth 20 formed midway along the washing line 18 to perform washing therein; a single washing robot 22 which is located at one side of the washing line 18 in the washing booth 20 and which has a fluid spray nozzle 84 constituting a fluid spray mechanism for spraying a high-pressure fluid to the painting truck 12 to perform washing; a turntable unit 24 for changing a posture of the painting truck 12 in the washing booth 20 and for turning part of the washing line 18 in the washing booth through 180° (to be described later) so as to allow each surface of the painting trucks 12 to oppose the spray nozzle 84; and a separation station 26, formed on the washing line 18 adjacent to the washing booth 20, to separate the painting truck 12 from the carrier 16.

Figure 3:
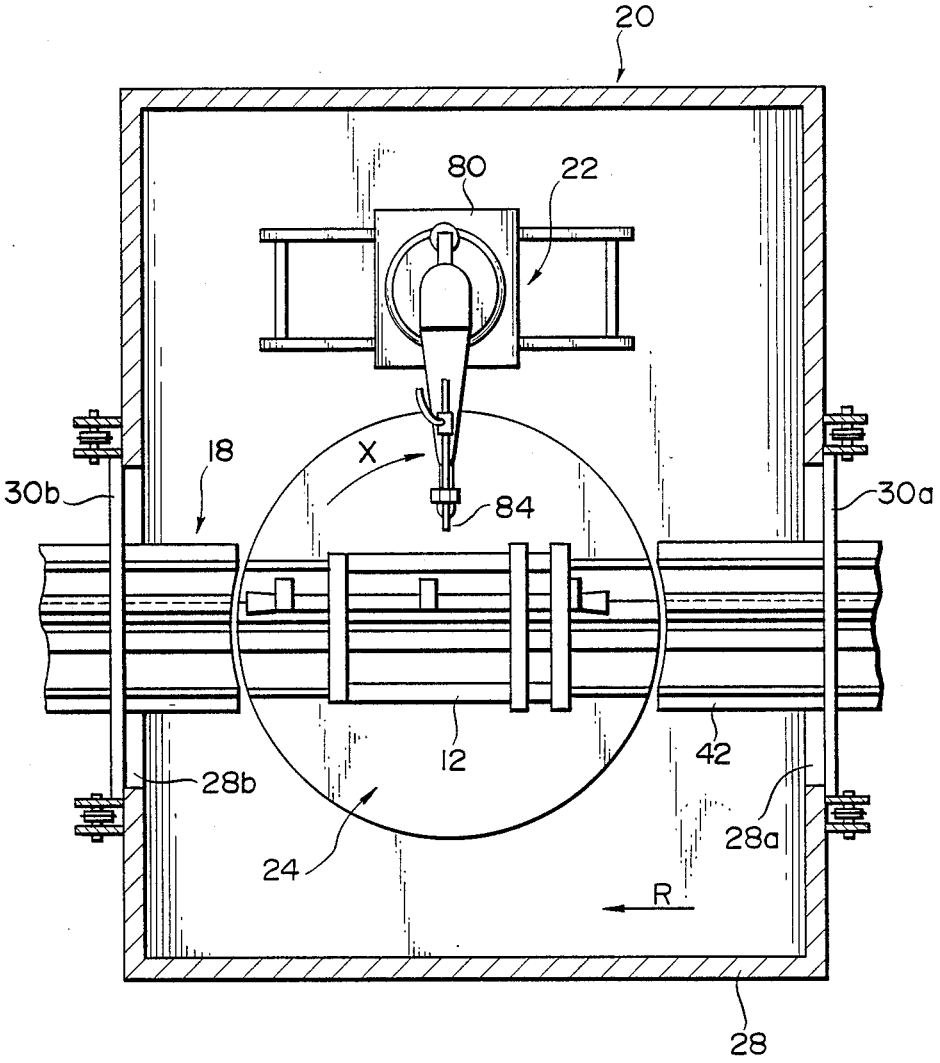
FIG. 3 is a plan view showing layout of a washing booth.

As shown in FIG. 3, the washing booth 20 is defined by an internal space surrounded by partition walls 28. A loading port **28*a* and an unloading port 28*b*** are formed in opposite wall surfaces, respectively.

Shutters **30*a* and 30*b* are mounted respectively on the loading and unloading ports 28*a* and 28*b*** so as to be capable of closing and opening the corresponding ports.

As shown in FIG. 1, the washing line 18 comprises: a pair of truck convey rails 32, extending along a convey direction R so as to convey the painting truck 12 from which the painted automobile body 14 is released, for forming a predetermined circulation convey path (part of the path is illustrated in FIG. 1); and a pair of carrier convey rails 34, disposed between the truck convey rails 32 and extending along the convey direction R, for conveying the carrier 16. The washing line 18 having the structure as described above extends into the washing booth 20 through the loading port 28*a* and leaves the washing booth 20 through the unloading port 28*b*.

Each truck convey rail 32 comprises a first rail portion 32*a*, one end of which extends into the washing booth 20 through the loading port 28*a*, a second rail portion 32*b* located on the turntable unit 24, and a third rail portion 32*c*, one end of which extends into the washing booth 20 through the unloading port 28*b*. The second rail portion 32*b* is installed by a length corresponding to the diameter of a turntable 54 (to be described later) of the turntable unit 24.

The other end of each first rail portion 32*a* is connected to the other end of the corresponding third rail portion 32*c* in a connecting station with a painting line (not shown). One end of each second rail portion 32*b* is selectively set to oppose one end of the corresponding first rail portion 32*a* and one end of the corresponding third rail portion 32*c* in accordance with rotation of the turntable unit 24. The other end of each second rail portion 32*b* is also selectively set to oppose one end of the corresponding first rail portion 32*a* and one end of the corresponding third rail portion 32*c* in accordance with rotation of the turntable unit 24.

Like each truck convey rail 32, each carrier convey rail 34 has a flat rolling surface with an open upper surface and comprises a first rail portion 34*a* one end of which extends into the washing booth 20 through the loading port 28*a*, a second rail portion 34*b* located on the turntable unit 24, a third portion 34*c*, one end of which extends into the washing booth 20 through the unloading port 28*b*, and a fourth rail portion 34*d* disposed independently on the separation station 26.

The other end of the first rail portion 34*a* of each carrier convey rail 34 is connected to the other end of the corresponding fourth rail portion 34*d* at a connecting station with the painting line (not shown). One end of each second rail portion 34*b* is selectively set to oppose one end of the corresponding first rail portion 34*a* and one end of the corresponding third rail portion 34*c* in accordance with rotation of the turntable unit 24. The other end of each second rail portion 34*b* is also selectively set to oppose one end of the corresponding first rail portion 34*a* and one end of the corresponding third rail portion 34*c* in accordance with rotation of the turntable unit 24.

Prior to a detailed description of the structure of the washing system 10, the structure of the painting truck 12 to be washed in the washing system 10 will be described in detail.

Figure 4:
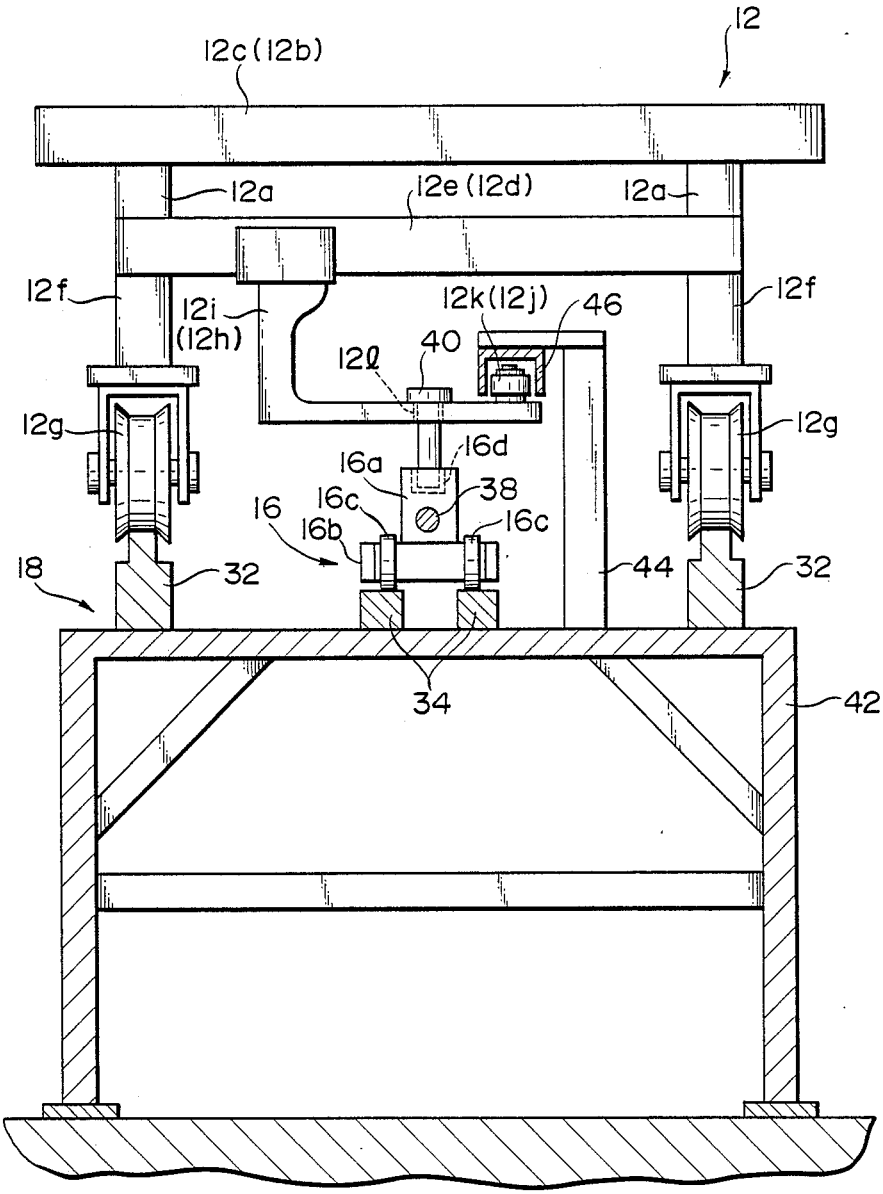
FIG. 4 is a side sectional view, taken along line IV—IV in FIG. 5, showing a rolling contact state between the painting truck and the truck convey rails and a rolling contact state between the carrier and the carrier convey rails.
Figure 6:
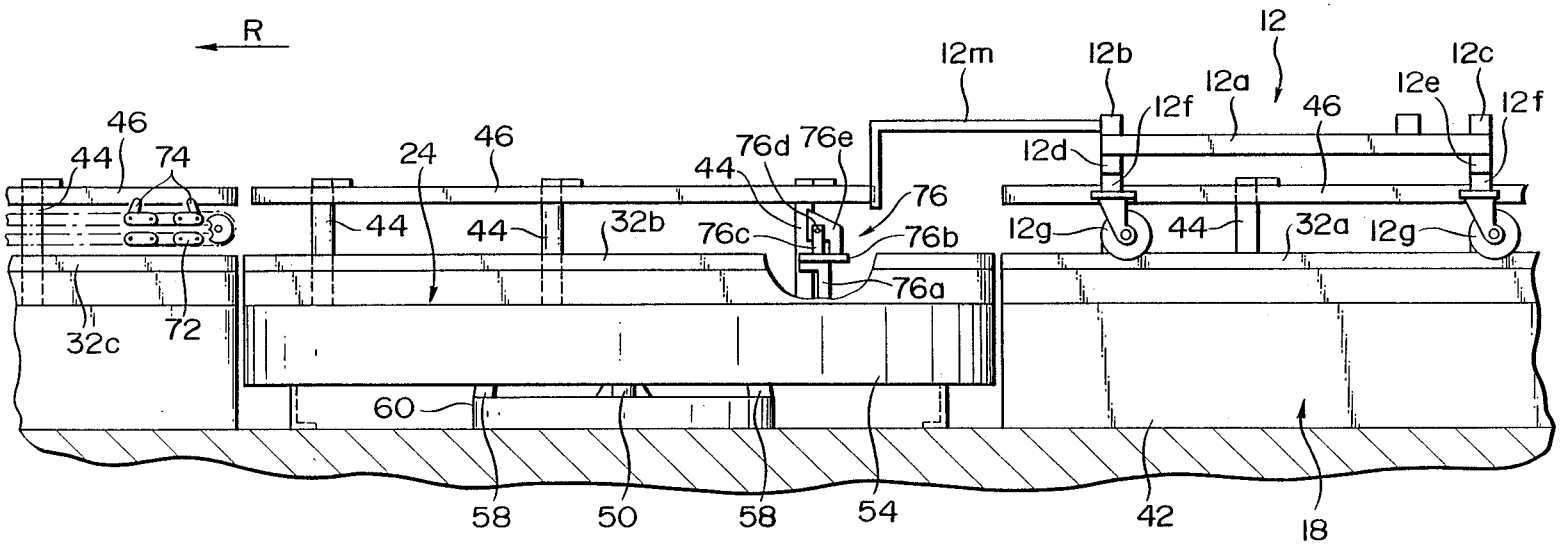
FIG. 6 is a front view showing a structure of the turntable unit together with a separation unit.

As shown in FIGS. 4 and 6, the painting truck 12 comprises: a rectangular frame formed by a pair of longitudinal members 12*a* extending along the convey direction R, an upper front transverse member 12*b*, extending perpendicularly to the longitudinal members 12*a* , for connecting the upper surfaces of the front end portions of the longitudinal members 12*a*, an upper rear transverse member 12*c* for connecting the upper surfaces of the rear end portions of the longitudinal members 12*a*, a lower front transverse member 12*d* for connecting the lower surfaces of the front end portions of the longitudinal members 12*a*, and a lower rear transverse member 12*e* for connecting the lower surfaces of the rear end portions of the longitudinal members 12*a*; legs 12*f* fixed at four corners of the lower surface of the frame and extending downward; and truck wheels 12*g* supported to be rotatable around horizontal axes fixed at the lower end portions of the legs 12*f*.

As shown in FIG. 4, substantially L-shaped brackets 12*h* and 12*i* are fixed at the central portions of the lower front and lower rear transverse members 12*d* and 12*e* constituting the frame of the painting truck 12. The proximal end portion of each bracket 12*h* and 12*i* extends downward, and its distal end portion extends in the transverse direction (i.e., a direction perpendicular to the convey direction R). The brackets 12*h* and 12*i* are mounted to (1) connect a carrier 16 (to be described in detail later), (2) stably define the convey direction of the painting truck 12, and (3) to engage with a reverse-running preventive unit 76 (to be described later).

Guide rollers 12*j* and 12*k* supported to be rotatable around vertical axes are mounted on the upper surfaces of the distal end portions of the brackets 12*h* and 12*i*, respectively. Vertical through holes 12 are respectively formed at the central portions of the brackets 12*h* and 12*i* in the widthwise direction of the painting truck 12. An engaging arm 12*m* is mounted at the central portion of the front surface portion of the upper front transverse member 12*b* of the painting truck 12 in the widthwise direction. The engaging arm 12*m* extends along the convey direction R. The proximal end portion of the engaging arm 12*m* extends forward along the convey direction R, and its distal end portion is bent downward.

Of the four truck wheels 12*g*, the front and rear wheels 12*g* located on one side are in rolling contact with one truck convey rail 32, and the front and rear wheels 12*g* located on the other side are in rolling contact with the other truck convey rail 32. Therefore, the painting truck 12 can run on the pair of truck convey rails 32 along the convey direction R.

The number of carriers 16 connected to the painting truck 12 to drive it, as described above, is set at four along the convey direction R, as shown in FIG. 2. The carriers 16 have identical structures. The frontmost first carrier 16 along the convey direction R is connected, through a first connecting rod 36 having a predetermined length, to the second carrier 16 located immediately below the bracket 12*h* to the lower front transverse member 12*d* of the painting truck 12. The rearmost fourth carrier 16 is connected, through a second connecting rod 38 having a predetermined length, to the third carrier 16 located immediately below the bracket 12*i* mounted to the lower rear transverse member 12*e* of the painting truck 12. As shown in FIG. 4, each carrier 16 comprises a carrier body 16*a*, a pair of front and rear rotating shafts 16*b* extending transversely from the carrier body 16*a*, and a pair of traveling rollers 16*c* rotatably supported at both ends of each rotating shaft 16*b*.

Engaging recesses 16*d* are formed on the upper surfaces of the carrier bodies 16*a* of the second and third carriers 16 so as to vertically communicate with the through holes 12 formed in the brackets 12*h* and 12*i*, respectively. Connecting pins 40 are inserted in the through holes 12 and the engaging recesses 16*d*from the upper direction, respectively. The lower ends of the connecting pins 40 are fitted in the engaging recesses 16*d*, respectively. In this manner, the brackets 12*h* and 12*i* are connected to the corresponding carrier bodies 16*a*. In other words, four carriers 16 are connected to the corresponding painting truck 12 through the corresponding connecting pin 40 and first and second connecting rods 36 and 38.

Of the traveling rollers 16c of the four carriers 16, the eight front and rear traveling rollers 16c located on one side are brought into rolling contact with one carrier convey rail 34, and the eight front and rear traveling rollers 16c located on the other side are brought into rolling contact with the other carrier convey rail 34. In this manner, each carrier 16 can travel on the pair of carrier convey rails 34 along the convey direction R.

The truck convey rails 32 and the carrier convey rails 34 are installed on a common base 42, as shown in FIG. 4.

A detailed structure of the washing system 10 will be described in detail with reference to FIGS. 4 to 10.

Figure 5:
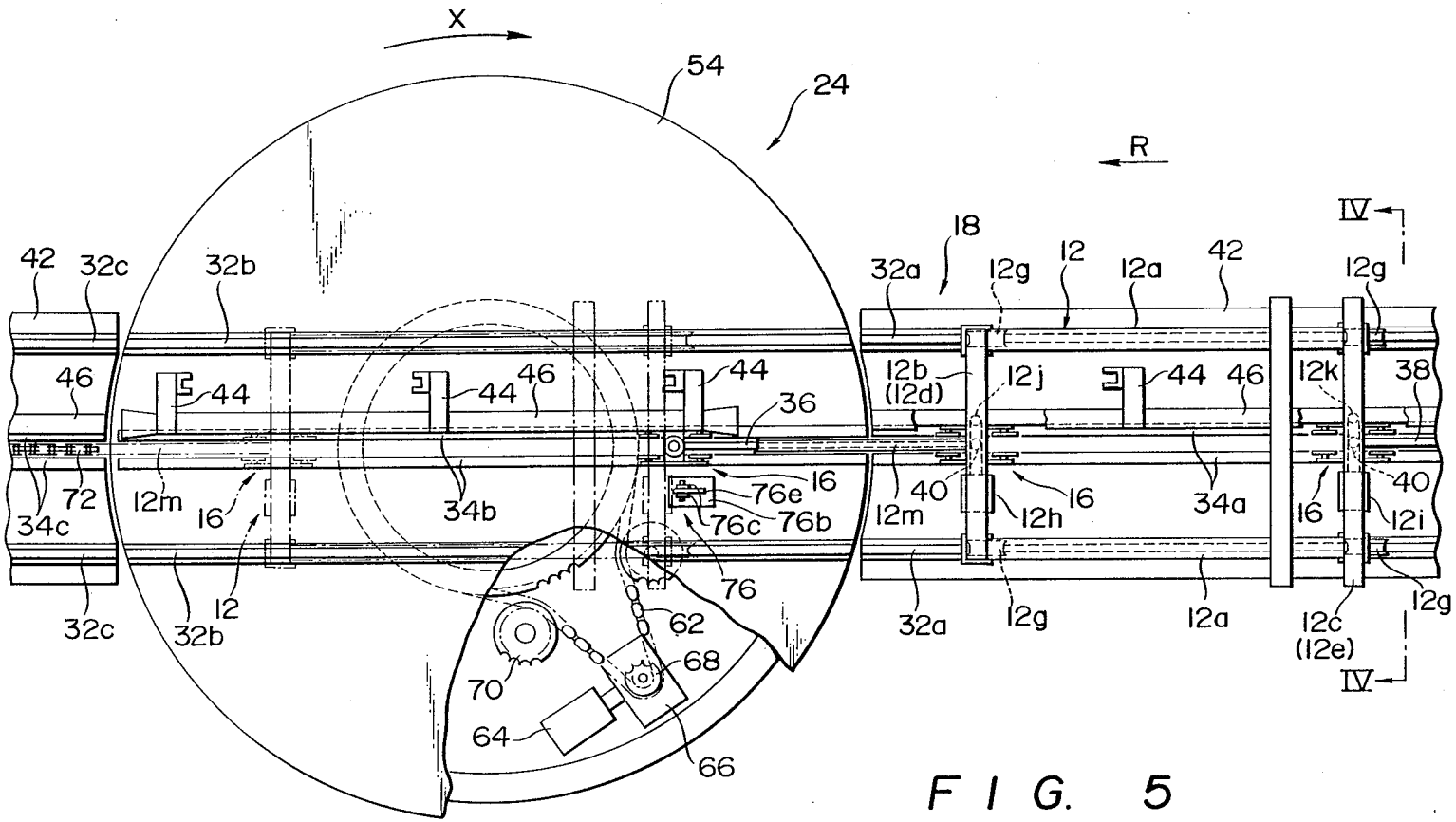
FIG. 5 is a plan view showing a partially cutaway state of a structure of a turntable unit.

As shown in FIG. 5, a plurality of support posts 44 extend upward on the base 42 at predetermined intervals along the convey direction R so as to be located between the pair of truck convey rails 32. The support posts 44 support an array of a plurality of guide rails 46 while the guide rails 46 are located above from the base 42 by a predetermined distance. The plurality of guide rails 46 are disposed at predetermined intervals along the convey direction R. Each guide rail 46 has an inverted trough shape (a hollow body having an open lower surface). The truck wheels 12g of the painting truck 12 are restricted in their conveying direction such that guide rollers 12j and 12k mounted on the brackets 12h and 12i are inserted in the guide rails 46 from below and are in rolling contact with the opposite inner surfaces of the rails 46, as shown in FIG. 4. Therefore, when the painting truck 12 travels along the pair of truck convey rails 32 through the truck wheels 12g, the position of the truck 12 along the widthwise direction of the truck convey rails 32 can be accurately defined. In other words, the transverse positional error can be prevented.

As is apparent from FIG. 5, each guide rail 46 is tapered outwardly from its lengthwise open end so as to easily receive the corresponding guide roller 12j or 12k.

The partition walls 28 of the washing booth 20 extend upright on the base 42. The base 42 located substantially at the center of the space defined by the partition walls 28 is circularly cut. The floor surface is exposed through the cut portion of the base 42. The turntable unit 24 is disposed on the exposed floor surface.

A detailed arrangement of the turntable unit 24 will be described with reference to FIGS. 5 to 7.

As shown in FIG. 6, the turntable unit 24 comprises a column 50 directly extending upright on the floor surface in the washing booth 20. A large-diameter sprocket 52 is supported to be rotatable around the column 50, as shown in FIG. 7. The turntable 54 is mounted on the upper surface of the sprocket 52 such that the upper surface of the turntable 54 is aligned with the upper surface of the base 42.

Figure 7:
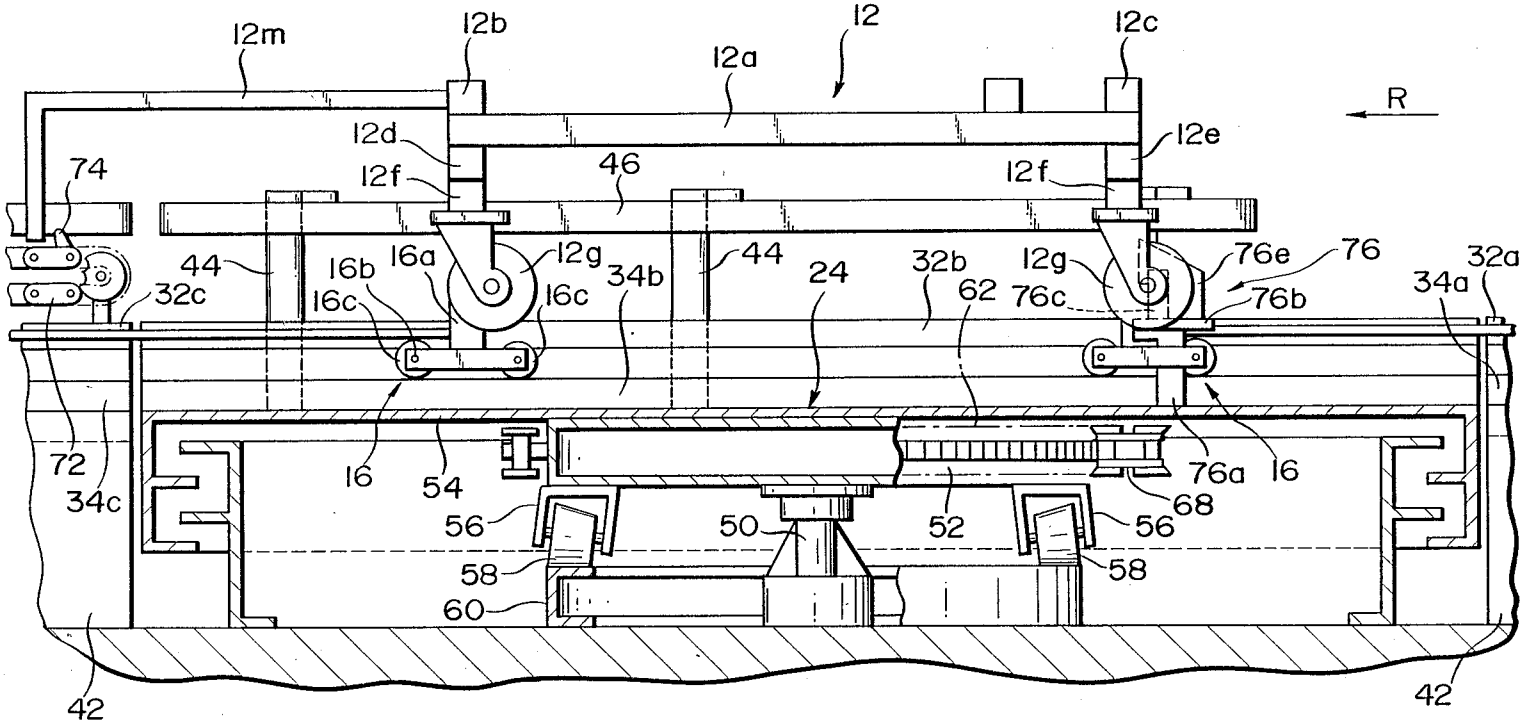
FIG. 7 is a front sectional view showing the structure of the turntable.

As shown in FIG. 7, support rollers 58 are rotatably mounted on the four corners of the lower surface of the sprocket 52 at equal angular intervals (i.e., 90°) through brackets 56. The support rollers 58 are in rolling contact with a support plate 60 placed on the floor surface of the washing booth 20, and support the turntable 54 so as to allow its smooth rotation.

An endless chain 62 is meshed with the sprocket 52 to rotate it. A drive motor 64 is mounted on the floor surface of the washing booth 20, as shown in FIG. 5. A reduction gear mechanism 66 is connected to the drive shaft of the drive motor 64 to reduce the motor speed and increase an output torque. A small-diameter sprocket 68 is coaxially fixed on the output shaft of the reduction gear mechanism 66. The chain 62 is meshed with the sprocket 68.

A tension pulley 70 is elastically meshed with the chain 62 so as to adjust the tension of the chain 62. Upon driving of the drive motor 64, the turntable 54 is rotated around the column 50.

The second rail portions 32b of the truck convey rails 32 and the second rail portions 34b of the carrier convey rails 34 are installed on the upper surface of the turntable 54. In other words, by providing such a turntable 54, the truck and carrier convey rails 32 and 34 are divided into the right and left portions as indicated by reference numerals 32a and 32c and reference numerals 34a and 34c with reference to the second rail portions 32b and 34b on the turntable 54. The guide rails 46 are supported by a plurality of support posts 44 mounted on the upper surface of the turntable 54. The guide rails 46 on turntable 54 are provided to be independent from the guide rails 46 on the base 42.

A drive chain 72 is looped between the portions of the truck convey rails 32 in the downstream side of the turntable 54, that is, between the third rail portions 32c to load the painting truck 12 in the turntable 54 or unload it therefrom. Pusher dogs 74 are mounted on the drive chain 72. Each pusher dog 74 can be engaged with the distal end portion of the engaging arm 12m fixed on the upper front transverse member 12b of the painting truck 12. The painting truck 12 having the engaging arm 12m which engages with the pusher dogs 74 of the drive chain 72 can thus travel along the truck convey rails 32.

Figure 8:
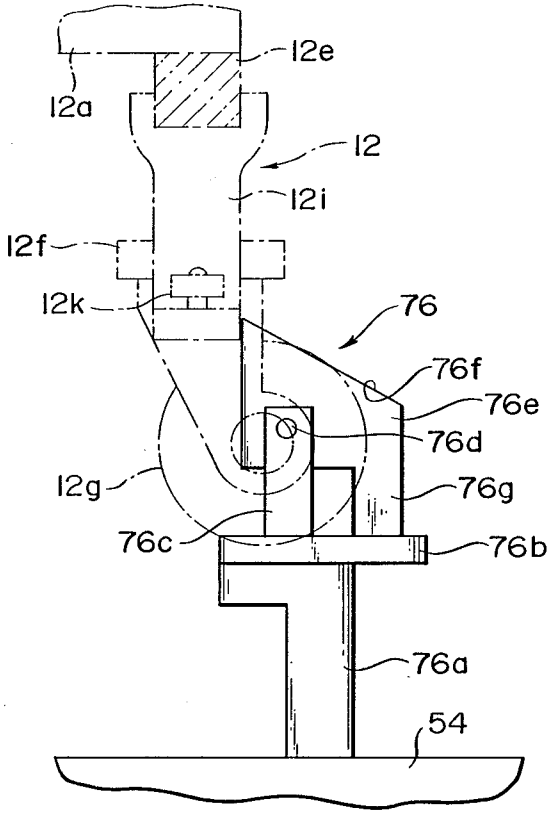
FIG. 8 is a front view showing a structure of a reverse-running preventive unit.

A reverse-running preventive unit 76 (to be described later) is disposed at a predetermined position on the upper surface of the turntable 54 on the loading side (i.e., the upstream side along the convey direction R) to prevent running of the painting truck 12 on the turntable 54 in the reverse direction. As shown in FIG. 8, the reverse-running preventive unit 76 comprises a rod 76a extending upright on the upper surface of the turntable 54, a horizontal flat plate 76b mounted on the upper surface of the rod 76a, a pair of brackets 76c fixed transversely on the upper surface portion of the flat plate 76b and spaced apart from each other by a predetermined distance, a rotating shaft 76d bridged between the pair of brackets 76c so as to extend in a direction perpendicular to the convey direction R, and a lock member 76e sandwiched between the pair of brackets 76c and supported to be rotatable around the rotating shaft 76d.

The lock member 76e is made of a flat plate extending along the convey direction R while it stands upright. The upper surface of the lock member 76e is constituted by a tilt surface 76f so as to obliquely cross the travel range of the brackets 12h and 12i respectively mounted on the lower transverse members 12d and 12e of the painting truck 12 which is traveling through the loading port 28a. A projection 76g integrally extends downward from the lower surface of the lock member 76e on the loading side. The lock member 76e is always biased clockwise about the rotating shaft 76d due to the weight of the projection 76g. As a result, the lower surface of the projection 76g elastically abuts against the upper surface of the flat plate 76b.

The structure of the washing robot 22 arranged at a position facing the washing line 18 in the washing booth 20 will be described with reference to FIG. 10.

The robot 22 comprises: a main body 80 installed on ground support adjacent the base 42 so as to be located on one side of the painting truck 12 located on the turntable 54 and actuated in the convey direction R; and an arm 82 mounted at the upper end portion of the main body 80 to extend in a direction perpendicular to the truck convey rails 32. A spray nozzle 84 is mounted on the distal end portion of the arm 82. The nozzle 84 is selectively connected to a water pipe 88 or an air pipe 90 through a selector 86. The water pipe 88 and the air pipe 90 are connected to a water pump (not shown) or an air pump (not shown), respectively. In this manner, upon operation of the selector 86, water or air is selectively sprayed at a high pressure.

In the washing system 10 having the structure described above, an operation for washing the painting truck 12 will be described below.

The painting truck 12 form which the automobile body 14 painted on a painting line (not shown) is released is washed to allow its use without problems in the next painting cycle. During washing, the painting truck 12 is firstly transferred from a painting line (not shown) to the washing line 18. As shown in FIG. 2, the four carriers 16 are driven along the carrier convey rails 34 through a convey driving mechanism (not shown), so that the painting truck 12 is conveyed along the convey direction indicated by the arrow R.

When the painting truck 12 comes close to the washing booth 20, the shutter 30*a* which has closed the loading port 28*a* of the partition wall 28 of the washing booth is opened, and the painting truck 12 driven by the carriers 16 is moved on the turntable 54 in the washing booth 20 through the open loading port 28*a*. The painting truck 12 is thus loaded on the turntable 54.

Figure 9:
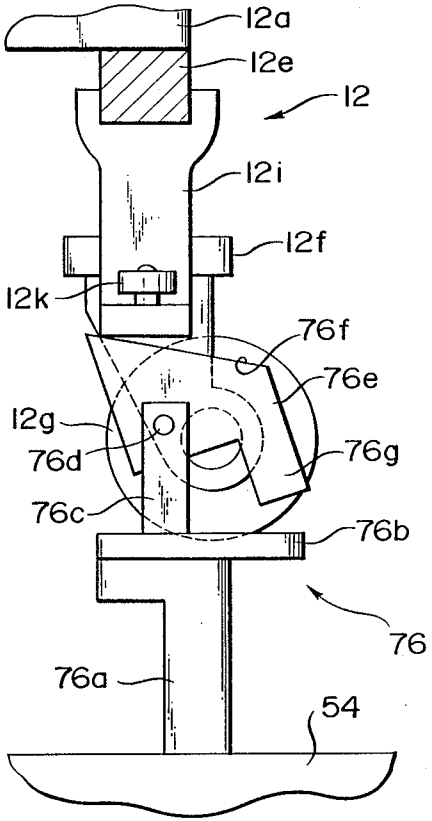
FIG. 9 is a front view showing a state wherein the painting unit passes the reverse-running preventive unit.

During loading, the tilt surface 76*f* of the lock member 76*e* in the reverse-running preventive unit 76 located on the upper surface of the turntable 54 is sequentially engaged with the lower edges of the brackets 12*h* and 12*i* which are respectively mounted on the lower front transverse member 12*d* and the lower rear transverse member 12*e* in the painting truck 12. During each engagement operation, the lock member 76*e* is pivoted counterclockwise, i.e., in a direction in which the lower end portion of the projection 76*g* is separated from the upper surface of the flat plate 76*b*, as shown in FIG. 9. Therefore, the painting truck 12 is allowed to move in the direction of the arrow R.

Thereafter, as shown in FIG. 6, when the painting truck 12 reaches a predetermined washing position on the turntable 54, the tilt surface 76*f* of the lock member 76*e* in the reverse-running preventive unit 76 is disengaged from the bracket 12*i* mounted on the lower rear transverse member 12*e*. The lock member 76*e* is pivoted clockwise due to the weight of the projection 76*g* until the projection 76*g* abuts against the upper surface of the flat plate 76*b*. In this state, as indicated by the alternate long and short dashed line in FIG. 8, the bracket 12*i* of the painting truck 12 abuts against the upright surface of the lock member 76*e* when the painting track 12 is moved backwards. As a result, reverse movement of the painting truck 12 on the turntable 54 in the direction of the arrow R is inhibited.

When the painting truck 12 is set at the predetermined washing position on the turntable 54, the shutter 30*a* closes the loading port 28*a*. The carriers 16 are then stopped, and conveyance of the painting truck 12 is thus stopped. In this halt state, the distal end of the engaging arm 12*m* of the painting truck 12 is brought into a position where it can be engaged with the pusher dogs 74 of the drive chain 72.

Figure 10:
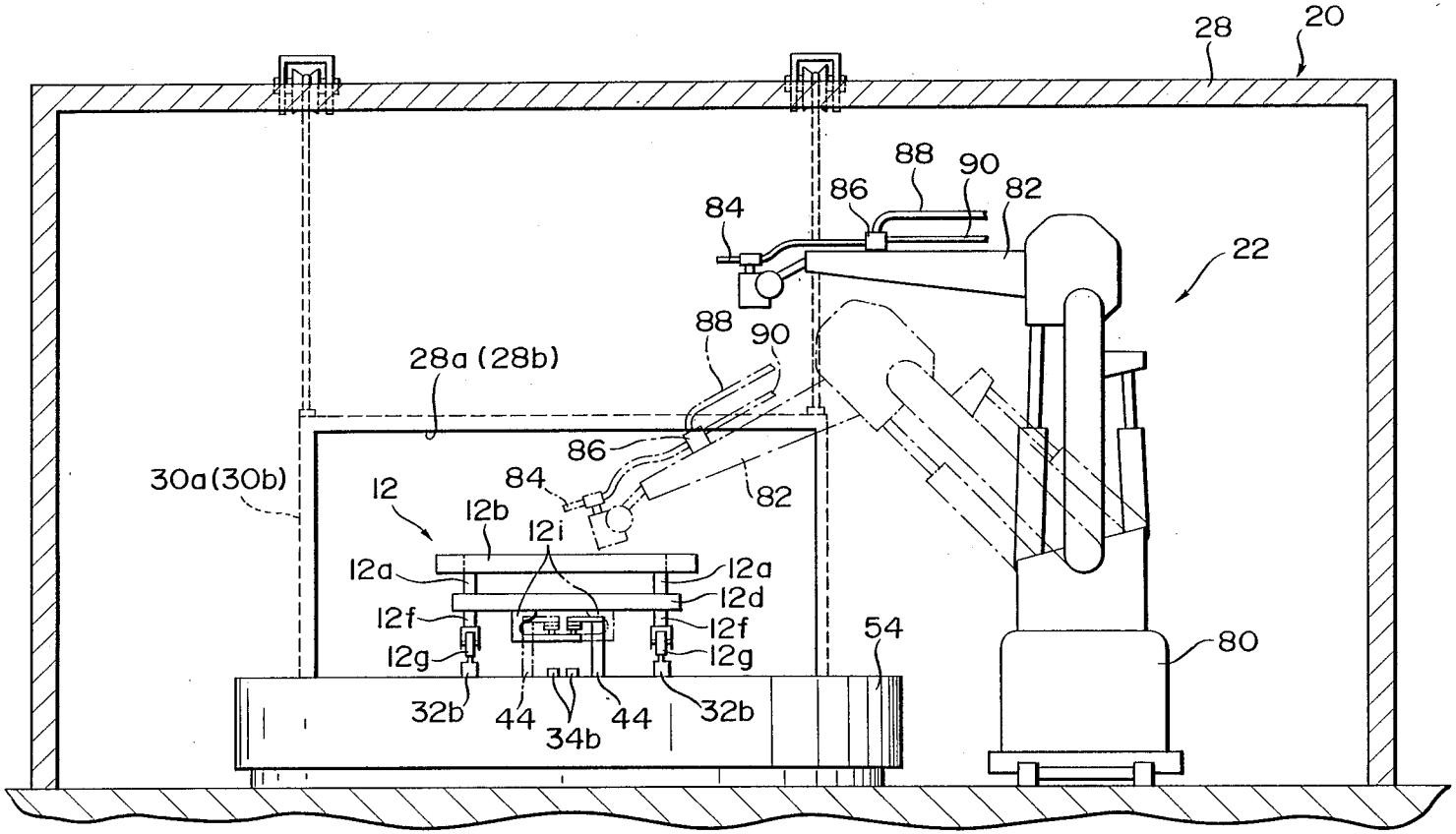
FIG. 10 is a side view showing a state wherein the painting truck is being washed in the washing booth.

When the painting truck 12 is loaded on the turntable 54 as described above, the main body 80 of the washing robot 22 is actuated, as indicated by the alternate long and short dashed line in FIG. 10. More specifically, compressed water through the water pipe 88 or compressed air through the air pipe 90 is selectively sprayed from the distal end of the nozzle 84 mounted on the arm 82 of the washing robot 22 upon selective operation of the selector 86. Water or air is injected to the surface of the painting truck 12 at a high pressure, thereby washing the painting truck 12. Upon completion of washing, the paint attached to the surfaces opposing the washing robot 22, i.e., the upper surface, the front surface, and the side surfaces of the painting truck 12 can be removed.

When the above side surfaces, the upper surface, and the front surface of the painting truck 12 are washed as described above, the washing robot 22 is stopped. The shutter 30*b* which has closed the unloading port 28*b* of the partition wall 28 is opened, and at the same time, the drive chain 72 is actuated. When the pusher dogs 74 mounted on the drive chain 72 are engaged with the distal end portion of the engaging arm 12*m* of the painting truck 12 located on the turntable 54, the painting truck 12 and the carriers 16 connected thereto are driven along the truck convey rails 32 and the carrier convey rails 34, respectively. In this manner, the painting truck 12 and the carriers 16 are unloaded from the washing booth 20 and are conveyed in the separation station 26.

When the painting truck 12 and the four carriers 16 reach the separation station 26, the drive chain 72 is stopped. Movement of the painting truck 12 along the truck convey rails 32 and movement of the carriers 16 along the carrier convey rails 34 are thus stopped.

In this state, the connecting pins 40 inserted in the through holes 12 of the brackets 12*h* and 12*i* of the painting truck 12 and the engaging recesses 16*d* of the second and third carriers 16 are manually removed by an operator, thereby separating the painting truck 12 from the carriers 16.

When the painting truck 12 is separated from the carriers 16, the drive chain 72 is driven in a direction opposite to that in an operation for unloading the painting truck 12 from the turntable 54. The painting truck 12 is moved in a direction opposite to that indicated by the arrow R. Only the painting truck 12 is loaded on the turntable 54. The unloading port 28*b* is then closed by the shutter 30*b* again.

Thereafter, in the turntable unit 24, the drive motor 64 located below the turntable 54 is started to turn the turntable 54 together with the painting truck 12 through 180° in a direction indicated by an arrow X (FIG. 3). In this case, the bracket 12*i* mounted on the lower rear transverse member 12*e* of the painting truck 12 is engaged with the upright surface of the lock member 76*e* of the reverse-running preventive unit 76 located on the upper surface of the turntable 54. Therefore, backward movement of the painting truck 12 from the turntable 54 upon rotation of the turntable 54 can be prevented and held on its position.

When the turntable 54 is rotated through 180°, the posture of the painting truck 12 on the turntable 54 can be turned through 180° with respect to the washing robot 22, as indicated by the alternate long and two short dashed line in FIG. 10.

In this state, the washing robot 22 is actuated again and compressed water or air from the water pipe 88 or the air pipe 90 is sprayed from the distal end of the nozzle 84 mounted on the arm 82 of the washing robot 22 to the surface of the painting truck 12 at a high pressure upon selective operation of the selector 86. The paint attached to the other side surface of the painting truck 12 can be removed.

When removal of the paint attached to all the surfaces of the painting truck 12 is completed, the operation of the washing robot 22 is stopped. The turntable 54 is then turned together with the washed painting truck 12 through 180° in a direction indicated by the arrow X (FIG. 3). The shutter **30*b* which has closed the unloading port 28*b* is opened. Thereafter, the drive chain 72 is started again, and the painting truck 12 is unloaded from the turntable 54 and brought into the separation station 26 again while the distal end portion of the engaging arm 12*m* is kept engaged with the pusher dogs 74 of the drive chain 72**.

In the separation station 26, the washed painting truck 12 is manually coupled to the remaining carriers 16 through the connecting pins 40. The carriers 16 are then driven by a drive mechanism (not shown) along the carrier convey rails 34. The washed painting truck 12 is thus conveyed along the truck convey rails 32 and unloaded from the separation station 26. The painting truck 12 is conveyed toward a painting line (not shown) in the next painting cycle.

The present invention is not limited to the arrangement of the first embodiment described above. Various changes and modifications may be made within the spirit and scope of the invention.

In the first embodiment described above, during washing in the washing booth 20 and more particularly during rotation of the turntable 54 so as to change the posture of the painting truck 12, the washing robot 22 interrupts spraying from the nozzle 84 upon selective operation of compressed water or air. However, the present invention is not limited to such an arrangement. The washing robot 22 may cause the nozzle 84 to selectively spray compressed water or air so as to continue washing even during rotation of the turntable 54. With this arrangement, the operating range of the washing robot 22 can be narrowed, and the manufacturing cost of the washing robot 22 can be reduced. In addition, the washing time can be shortened, and washing efficiency can be further improved.

In the first embodiment described above, the connecting pins 40 are removed by the operator in the separation station. In other words, the painting truck 12 is manually separated from or connected to the carriers 16. However, the present invention is not limited to such an arrangement. As will be described in a second embodiment, the separation station 26 may be arranged such that the painting unit 12 is automatically attached to or detached from the carriers 16.

Figure 11:
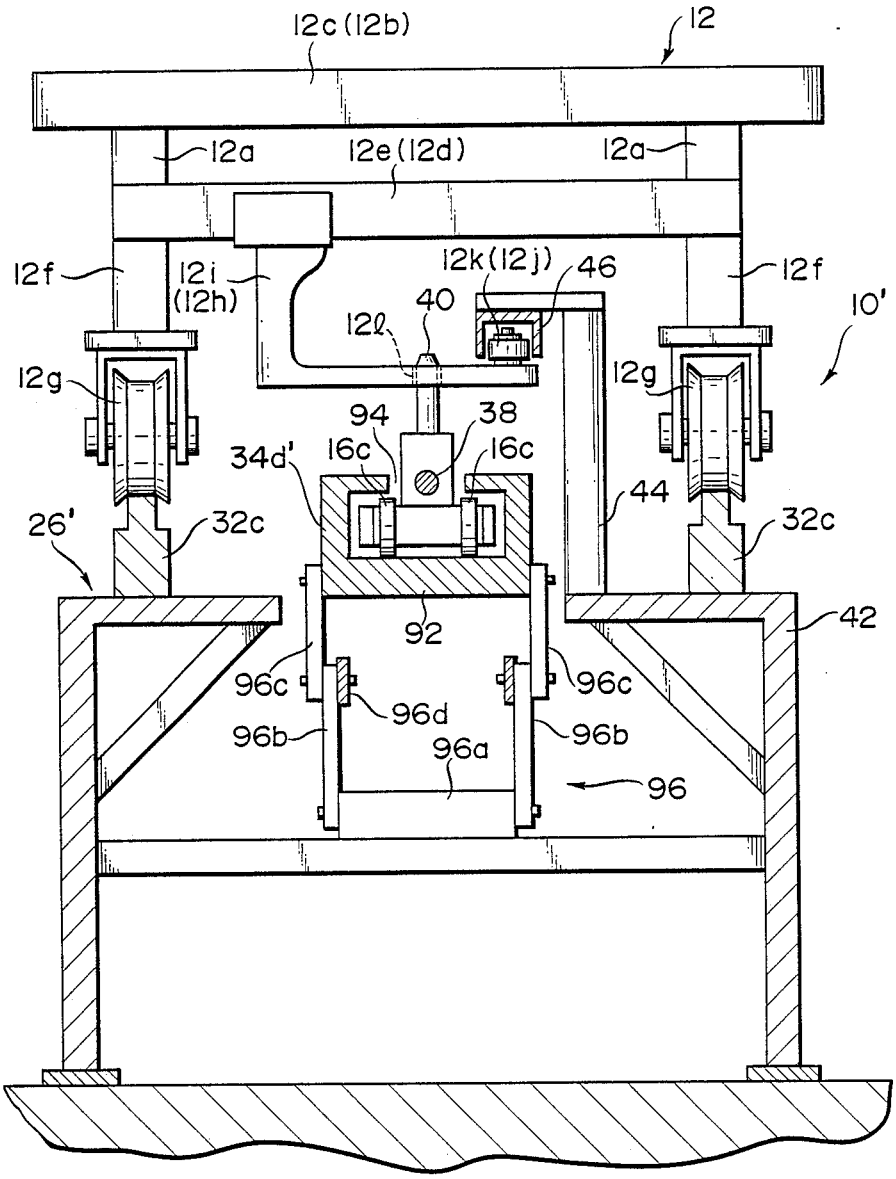
FIG. 11 is a side sectional view showing an engaging state between a carrier and a carrier convey rail in a washing system according to a second embodiment of the present invention.
Figure 12:
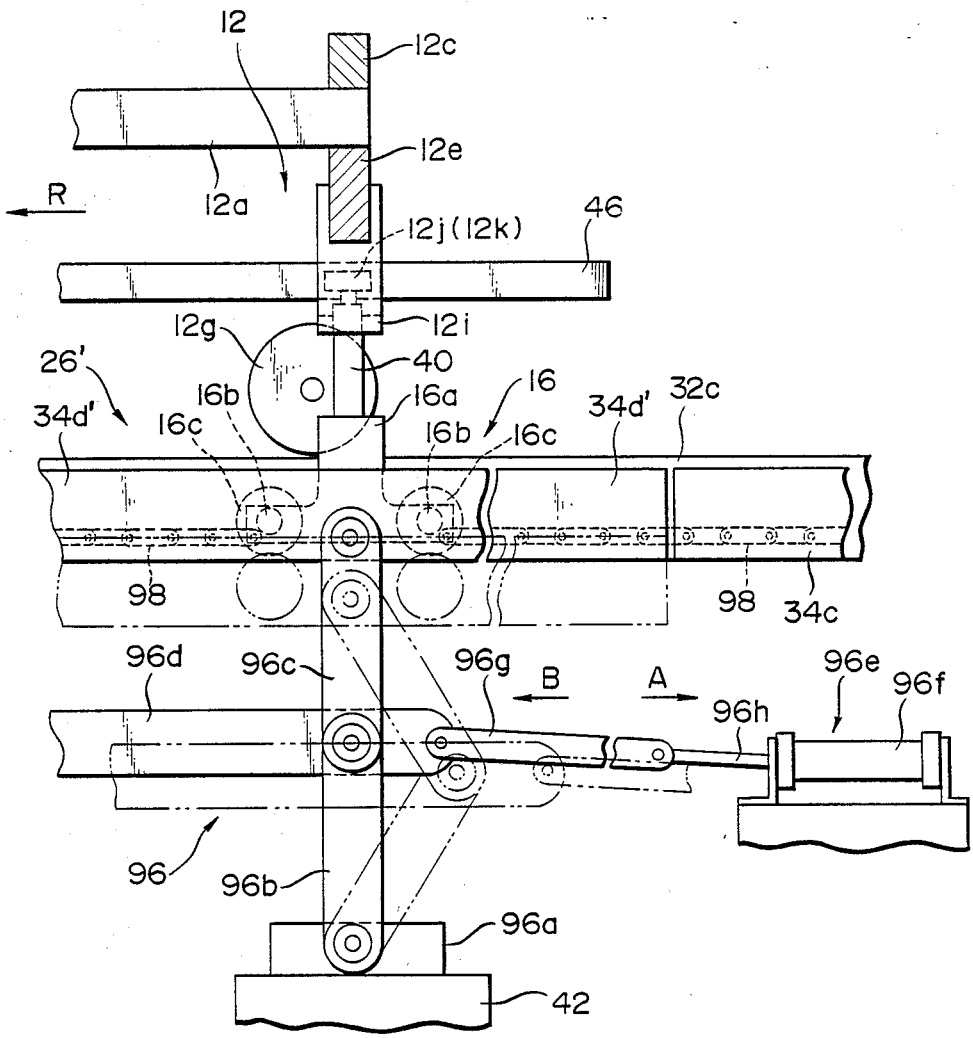
FIG. 12 is a front view showing a structure of an automatic separating mechanism.

The second embodiment of the present invention will be described with reference to FIGS. 11 and 12. The same reference numerals as in the first embodiment denote the same parts in the second embodiment, and a detailed description thereof will be omitted.

In a washing system 10' of the second embodiment, a separation station 26' has a function for automatically connecting a painting truck 12 to carriers 16 or separate the truck 12 from the carriers 16. In addition, in carrier convey rails 34 along which the carriers 16 are driven, the structure of a fourth rail portion **34*d'* located on the separation station 26' is different from that of the first embodiment. During washing, the painting truck 12 to be washed passes together with the carriers 16 through a washing booth 20 and is conveyed to the separation station 26'. The painting truck 12 then can be automatically separated from the carriers 16, returned to the washing booth 20 without carriers 16**, and then washed therein.

The structure of the fourth rail portion **34*d'* of the carrier convey rail 34 which is located on the separation station 26' will be described with reference to FIG. 11**.

The surfaces of the pair of carrier convey rails 34, which are brought into rolling contact with the travel rollers **16*c* of the carriers 16, are constituted by open flat upper surfaces in the first embodiment. However, in the second embodiment, the rail portion 34*d'* is constituted by one hollow body 92 extending along the convey direction R and having a rectangular cross section. The hollow body 92 has a size such that the travel rollers 16*c* of the carriers 16 can travel in the internal space of the body 92**.

The upper surface of the inner bottom portion of the hollow body 92 is defined as a surface with which the travel rollers **16*c* of the carriers 16 are brought into rolling contact. An elongated groove 94 is formed on the upper surface of the hollow body 92** so as to extend along the convey direction R.

Carrier body **16*a* of the carrier 16 is inserted through the elongated groove 94. The groove 94 has a size enough to allow movement of the carrier 16** along the convey direction R.

The carrier convey rail 34 has this fourth rail portion **34*d'* located in the separation station 26' and different from that of the first embodiment. Other portions, i.e., the first and third rail portions 34*a* and 34*c* located on the base 42 except for the separation station 26' and the second rails 34*b* located on the turntable 54** have the same arrangement as those of the first embodiment.

In the first embodiment, the connecting pin 40 is engaged with the engaging recess **16*d* formed on the upper surface of the carrier body 16*a* from the above. However, in the second embodiment, the connecting pin 40 is fixed and stand upright on the upper surface of the carrier body 16*a*. The fourth rail portion 34*d'* of the carrier convey rail 34 which is located on the separation station 26' is supported to be vertically movable and is connected to an automatic separation mechanism 96 (to be described later). The fourth rail portion 34*d'*** can thus be vertically moved during connection/separation.

The structure of the automatic separation mechanism 96 in the separation station 26' will be described with reference to FIG. 12.

The automatic separation mechanism 96 comprises: a plurality of mounting pieces **96*a* fixed on the base 42 located in the separation station 26' at predetermined intervals along the convey direction R; a pair of first links 96*b*, lower ends of which are respectively pivotally supported to both sides of each mounting piece 96*a*; and a pair of second links 96*c*, upper ends of which are respectively pivotally supported to both side surfaces of the fourth rail portion 34*d'* of the carrier convey rail 34 located immediately above each mounting piece 96*a*. The upper and lower ends of the first and second links 96*b* and 96*c* which constitute a pair are pivotally coupled. Pivot portions (only one pivot portion is illustrated in FIG. 11) of the first and second links 96*b* and 96*c* are coupled by a common connecting rod 96*d*** extending along the convey direction R.

The connecting rod **96*d* can be moved in a direction indicated by an arrow A from a state wherein the first and second links 96b and 96c are vertically coupled in tandem with each other. However, the connecting rod 96 prevents a state wherein the rod 96d is moved in a direction of an arrow B so as to bend backwards the first and second links 96b and 96c**.

One end of the connecting rod 96d is connected to a drive mechanism 96e. In the second embodiment, the drive mechanism 96e is constituted by a pneumatic cylinder mechanism. The pneumatic cylinder mechanism 96e comprises a cylinder body 96f, an air source (not shown) for supplying compressed air to the cylinder body 96f, a piston (not shown) slidably fitted in the cylinder body 96f, and a piston rod 96h connected to the piston so as to externally extract one end from the cylinder body 96f. This end of the piston rod 96h is connected to the connecting rod 96d through a connecting arm 96g.

In the pneumatic cylinder mechanism 96e, when compressed air is supplied from the air source to the right cylinder chamber of the cylinder body 96f, the piston and therefore the piston rod 96h is pushed outward, i.e., in a direction indicated by the arrow B. As a result, the first and second links 96b and 96c are vertically aligned in line. The rail portion 34d' connected to the second link 96c is biased to the uppermost position. Note that a carrier connecting mode is set in a state wherein the fourth rail portion 34d' of the carrier convey rail 34 is set at the uppermost position, as indicated by the solid line in FIG. 12.

In the pneumatic cylinder mechanism 96e, when compressed air is supplied from the air source to the left cylinder chamber of the cylinder body 96f, the piston rod 96h is retracted in the direction indicated by the arrow A. The first and second links 96b and 96c are bent, as indicated by the alternate long and two short dashed line, from the vertically aligned state. The rail portion 34d' connected to the second link 96c is moved from the uppermost position to the lowermost position. A carrier separation mode is set when the fourth rail portion 34d' of the carrier convey rail 34 is set in the lowermost position, as indicated by the alternate long and two short dashed line in FIG. 12.

The carriers 16 are connected by a chain 98 (as a power line) constituting a travel drive mechanism for driving the carriers. The chain 98 is driven by a drive source (not shown) in the convey direction R, so that the carriers 16 can be simultaneously driven in the convey direction R.

Washing of the washing system 10' having the above arrangement according to the second embodiment of the present invention will be described below.

When painting of an automobile body 14 placed on the painting truck 12 is completed, the automobile body 14 is released from the painting truck 12. The painting truck 12 is then conveyed along the truck convey rails 32 while it is connected through the connecting pins 40 to the carriers 16 which travel along the carrier convey rails 34. In the washing booth 20, shutters 30a and 30b which respectively close loading and unloading ports 28a and 28b are opened. The painting truck 12 passes together with the carriers 16 through the washing booth 20 and is conveyed to the separation station 26'.

During passing of the painting truck 12 through the washing booth 20, a reverse-running preventive unit 76 is operated as in the first embodiment. Therefore, traveling of the truck 12 along the convey direction R is allowed without problems.

A truck positioning unit (not shown) is arranged in the separation station 26' and the painting truck 12 is positioned at a predetermined separation position and is stopped. The truck positioning unit clamps the distal end of an engaging arm 12m of the painting truck 12 to stop it. At this separation position, both the painting truck 12 and the carriers 16 are located within the separation station 26'.

When positioning is completed, the fourth rail portion 34d' of the carrier convey rail 34 located on the separation station 26' is moved downward from the uppermost position to the lowermost position since the automatic separation mechanism 96 is started and the piston rod 96h is retracted in the direction of the arrow A. As a result, the carriers 16 brought into the separation station 26' are moved downward upon downward movement of the fourth rail portion 34d'. By this downward movement, the connecting pins 40 which connect the painting truck 12 to the carriers 16 are removed downward from through holes 12 of the painting truck 12. Therefore, the painting truck 12 is separated from the carriers 16. In this manner, only the painting truck 12 is left on the truck convey rails 32 and can freely travel therealong.

When the fourth rail portion 34d' is moved downward to separate the painting truck 12 from the carriers 16, only the painting truck 12 is moved backward and returns to the washing booth 20. The painting truck 12 is conveyed since pusher dogs 74 mounted on the drive chain 72 are engaged with the engaging arm 12m of the painting truck 12 and the drive chain 72 is driven as in the first embodiment. When the painting truck 12 is loaded in the washing booth 20, the loading and unloading ports 28a and 28b are closed through the shutters 30a and 30b, respectively, thereby starting the washing operation.

Positioning of the painting truck 12 within the washing booth 20 is performed such that the upright surface of the lock member 76e of the reverse-running preventive unit 76 abuts against the bracket 12i of the painting truck 12.

Washing within the washing booth 20 in the second embodiment is the same as that in the first embodiment. All the surfaces of the painting truck 12 can be washed such that the turntable 54 is turned through 180° after surfaces of the painting truck 12 which oppose the washing robot 22 is washed.

When all the surfaces of the painting truck 12 are completely washed, the turntable 54 is further turned through 180° to restore the home position. The unloading port 28b is then opened and the washed painting truck 12 is transferred again to the separation station 26 through the unloading port 28b. Thereafter, the automatic separation mechanism 96 is operated in the reverse direction to cause the piston rod 96h to extend in the direction of the arrow B. The fourth rail portion 34d' is moved upward and the carriers 16 placed thereon are also moved upward. The connecting pins 40 extending on the carriers 16 are then inserted into the through holes 12 formed on the brackets 12h and 12i of the painting truck 12 from below. As a result, the painting truck 12 is connected to the carriers 16 again with respect to the convey direction R. Therefore, the washed painting truck 12 and the carriers 16 can return to the painting process again.

According to the second embodiment as described above, the carriers 16 are separated from the painting truck 12 during washing for removing the paint from the painting truck 12. Only the painting truck 12 can be washed. Therefore, a washing solution does not flow into the carrier 16 or reliability of components of the carrier 16 is not degraded.

As many apparently widely different embodiments of the present invention can be made without departing from the spirit and scope thereof, it is to be understood that the invention is not limited to the specific embodiments thereof except as defined in the appended claims.

What is claimed is:

1. A painting truck washing system, comprising:

(a) painting truck which supported an object to be painted during painting of the object;

(b) fluid spraying means, disposed on one side of the painting truck, for spraying a high-pressure fluid to said painting truck from which the object is released, thereby washing said painting truck, said fluid spraying means including liquid spraying means for spraying a high-pressure liquid to at least said painting truck;

(c) posture changing means for changing a posture of said painting truck subjected to washing with respect to said fluid spraying means;

(d) truck conveying means for conveying said painting truck along a predetermined convey direction; and (e) connecting/separating means for connecting said painting truck to said truck conveying means when said painting truck is conveyed by said truck conveying means, and for separating said painting truck from said truck conveying means when said painting truck conveyed to the predetermined position by said truck conveying means is moved to said posture changing means.

2. The washing system according to claim 1, wherein said fluid spraying means includes:

a robot provided with a robot body and an arm connected to the robot body;

a nozzle attached to the arm; and means for supplying high-pressure fluid.

3. The washing system according to claim 1, wherein said truck conveying means includes:

a power line driven along the convey direction; and a carrier connected to said power line and caused to travel upon driving of said power line, said carrier being disposed below said painting truck and being connected/separated to/from said painting truck by said connecting/separating means from below.

4. The washing system according to claim 3, wherein said connecting/separating means includes:

a vertically movable connecting pin; and displacing means for displacing said connecting pin between a position where said painting truck is connected to said carrier and a position where said painting truck is separated from said carrier, thereby automatically connecting/separating said painting truck to/from said carrier.

5. The washing system according to claim, 3, which further comprises a washing booth which accommodates said liquid spraying means and said posture changing means, and wherein said liquid spraying means is disposed on one side of said painting truck above said posture changing means in said washing booth.

6. The washing system according to claim 5, wherein said connecting/separating means is displaced to separate said painting truck from said carrier prior to loading of said painting truck in said washing booth during conveyance of said painting truck onto said posture changing means.

7. The washing system according to claim 1, wherein said posture changing means includes a turntable on which said painting truck is placed, said turntable being provided with a vertical rotating shaft, and said fluid spraying means is disposed on one side of said posture changing means.

8. The washing system according to claim 7, which further comprises reverse-running preventing means, disposed on said turntable on a loading side of said painting truck, for preventing movement of said painting truck loaded on said turntable in a direction opposite to a loading direction.

9. The washing system according to claim 7, wherein said fluid spraying means sprays the high-pressure fluid to surfaces of said painting truck on said turntable, said surfaces opposing said fluid spraying means, and said posture changing means turns said turntable to change the posture of said painting truck with respect to said fluid spraying means after said surfaces of said painting truck is completely washed by said fluid spraying means.

10. The washing system according to claim 9, wherein said fluid spraying means stops spraying of the fluid while the said turntable is turned by said posture changing means to change the posture of said painting truck.

11. The washing system according to claim 9, wherein said fluid spraying means continues spraying of the fluid while said turntable is turned by said posture changing means to change the posture of said painting truck.

12. The washing system according to claim 1, wherein said fluid spraying means includes:

a first tube for supplying a high-pressure liquid;

a second tube for supplying a high-pressure gas;

a nozzle, a distal end of which is located to oppose said posture changing means, the high-pressure liquid and the high-pressure gas being selectively sprayed from said distal end of said nozzle; and selecting means, interposed between said nozzle and said first and second tubes, for selectively supplying the high-pressure liquid and gas respectively supplied through said first and second tubes to said nozzle.

13. A painting truck washing system, comprising:

(a) a painting truck which supported an object to be painted during painting of the object;

(b) fluid spraying means, disposed on one side of the painting truck, for spraying a high-pressure fluid to said painting truck from which the object is released, thereby washing said painting truck; and (c) posture changing means for changing a posture of said painting truck subjected to washing with respect to said fluid spraying means, said posture changing means including a rotatable turntable on which said painting truck is placed;

(d) reverse-running preventing means, disposed on said turntable on a loading side of said painting truck, for preventing movement of said painting truck loaded on said turntable in a direction opposite to a loading direction; and wherein said fluid spraying means is disposed on one side of said posture changing means and sprays the high-pressure fluid to surfaces of said painting truck on said turntable opposing said fluid spraying means, and said posture changing means turns said turntable to change the posture of said painting truck with respect to said fluid spraying means after said surfaces of said painting truck are completely washed by said fluid spraying means.

14. The washing system according to claim 13, wherein said fluid spraying means includes:

a robot provided with a robot body and an arm connected to the robot body;

a nozzle attached to the arm; and means for supplying high-pressure fluid.

15. The washing system according to claim 13, wherein said fluid spraying means stops spraying of the fluid while the said turntable is turned by said posture changing means to change the posture of said painting truck.

16. The washing system according to claim 13, wherein said fluid spraying means continues spraying of the fluid while said turntable is turned by said posture changing means to change the posture of said painting truck.

* * * * *